US008004206B2

(12) United States Patent
Sanchez

(10) Patent No.: US 8,004,206 B2
(45) Date of Patent: Aug. 23, 2011

(54) METHOD AND CIRCUIT FOR CORRECTING A DIFFERENCE IN LIGHT OUTPUT AT OPPOSITE ENDS OF A FLUORESCENT LAMP ARRAY

(75) Inventor: Jorge Sanchez, Poway, CA (US)

(73) Assignee: Tecey Software Development KG, LLC, Dover, DE (US)

( * ) Notice: Subject to any disclaimer, the term of this patent is extended or adjusted under 35 U.S.C. 154(b) by 402 days.

(21) Appl. No.: 12/042,753

(22) Filed: Mar. 5, 2008

(65) Prior Publication Data

US 2008/0315792 A1 Dec. 25, 2008

Related U.S. Application Data

(60) Provisional application No. 60/893,024, filed on Mar. 5, 2007.

(51) Int. Cl.
*H05B 37/02* (2006.01)

(52) U.S. Cl. ..... 315/291; 315/294; 315/307; 315/312

(58) Field of Classification Search ..... 315/224–225, 315/276, 283, 291, 294, 297, 307–309, 312
See application file for complete search history.

(56) References Cited

U.S. PATENT DOCUMENTS

| | | | | |
|---|---|---|---|---|
| 4,640,616 | A * | 2/1987 | Michalik | 356/136 |
| 5,892,336 | A * | 4/1999 | Lin et al. | 315/291 |
| 7,075,245 | B2 * | 7/2006 | Liu | 315/219 |
| 7,227,315 | B2 * | 6/2007 | Shinbo et al. | 315/224 |
| 7,619,371 | B2 * | 11/2009 | Chen | 315/291 |
| 2002/0005861 | A1 | 1/2002 | Lewis | |
| 2002/0110376 | A1 | 8/2002 | MacLean | |
| 2004/0066153 | A1 * | 4/2004 | Nemirow et al. | 315/291 |
| 2004/0183465 | A1 * | 9/2004 | Jang | 315/224 |
| 2005/0156542 | A1 * | 7/2005 | Lin | 315/312 |
| 2006/0049959 | A1 | 3/2006 | Sanchez | |
| 2006/0226792 | A1 | 10/2006 | Yeh | |
| 2007/0145911 | A1 * | 6/2007 | Jin | 315/282 |
| 2008/0122387 | A1 * | 5/2008 | Chien | 315/307 |

OTHER PUBLICATIONS

International Search Report for PCT/US2008/055967 mailed Aug. 20, 2008.
Written Opinion of the International Searching Authority for PCT/US2008/055967 mailed Aug. 20, 2008.
International Preliminary Report on Patentability for PCT/US2008/055967 mailed Nov. 3, 2009.

* cited by examiner

*Primary Examiner* — Douglas W Owens
*Assistant Examiner* — Tung X Le
(74) *Attorney, Agent, or Firm* — Schwabe, Williamson & Wyatt, P.C.

(57) ABSTRACT

A method and electrical circuit corrects a difference in light output at opposite ends of a fluorescent lamp array. An electrical circuit for correcting a difference in light output at the ends of a fluorescent lamp array includes a microcontroller and firmware for generating a first pulse-width modulated inverter switch control signal having a first duty cycle that may be varied by computer program instructions executed by the microcontroller. An inverter bridge driver is coupled to the microcontroller for generating a switching signal for a first inverter bridge from the first pulse-width modulated inverter switch control signal to generate a first inverter voltage having a magnitude determined by the first duty cycle.

30 Claims, 8 Drawing Sheets

METHOD AND CIRCUIT FOR CORRECTING A DIFFERENCE IN LIGHT OUTPUT AT OPPOSITE ENDS OF A FLUORESCENT LAMP ARRAY

CROSS-REFERENCES TO RELATED APPLICATIONS

This application claims the benefit of U.S. Provisional Application No. 60/893,024 filed on Mar. 5, 2007, entitled METHOD AND CIRCUIT FOR CORRECTING A DIFFERENCE IN LIGHT OUTPUT AT OPPOSITE ENDS OF A FLUORESCENT LAMP ARRAY, which is hereby expressly incorporated by reference in its entirety for all purposes.

BACKGROUND OF THE INVENTION

1. Field of the Invention

The present invention is directed to controlling fluorescent lamps. More specifically, but without limitation thereto, the present invention is directed to a method and circuit for correcting a difference in light output at opposite ends of a fluorescent lamp array.

2. Description of Related Art

Fluorescent lamp arrays are typically incorporated into backlights for liquid crystal displays (LCD) used, for example, in computers and television receivers. As the size of the displays for these applications increases, the length of the fluorescent lamps increases to accommodate the larger display width. As the length of the fluorescent lamps is increased, there is a noticeable difference in the light output at the ends of the fluorescent lamp array. Several devices have been employed in the prior art to correct the difference in light output at opposite ends of a fluorescent lamp array.

SUMMARY OF THE INVENTION

In one embodiment, an electrical circuit for correcting a difference in light output at opposite ends of a fluorescent lamp array includes:

a microcontroller and firmware for generating a first pulse-width modulated inverter switch control signal having a first duty cycle that may be varied by computer program instructions executed by the microcontroller; and an inverter bridge driver coupled to the microcontroller for generating a switching signal for a first inverter bridge from the first pulse-width modulated inverter switch control signal to generate a first inverter voltage having a magnitude determined by the first duty cycle.

In another embodiment, firmware for correcting a difference in light output at the ends of a fluorescent lamp array includes steps of:

generating a first pulse-width modulated inverter switch control signal having a first duty cycle that may be varied by computer program instructions executed by a microcontroller; and generating a switching signal for a first inverter bridge from the first pulse-width modulated inverter switch control signal to generate a first inverter voltage having a magnitude determined by the first duty cycle.

BRIEF DESCRIPTION OF THE DRAWINGS

The above and other aspects, features and advantages will become more apparent from the description in conjunction with the following drawings presented by way of example and not limitation, wherein like references indicate similar elements throughout the several views of the drawings, and wherein.

Elements in the figures are illustrated for simplicity and clarity and have not necessarily been drawn to scale. For example, the dimensions, sizing, and/or relative placement of some of the elements in the figures may be exaggerated relative to other elements to clarify distinctive features of the illustrated embodiments. Also, common but well-understood elements that may be useful or necessary in a commercially feasible embodiment are often not depicted in order to facilitate a less obstructed view of the illustrated embodiments.

DESCRIPTION OF THE ILLUSTRATED EMBODIMENTS

The following description is not to be taken in a limiting sense, rather for the purpose of describing by specific examples the general principles that are incorporated into the illustrated embodiments. For example, certain actions or steps may be described or depicted in a specific order to be performed. However, practitioners of the art will understand that the specific order is only given by way of example and that the specific order does not exclude performing the described steps in another order to achieve substantially the same result. Also, the terms and expressions used in the description have the ordinary meanings accorded to such terms and expressions in the corresponding respective areas of inquiry and study except where other meanings have been specifically set forth herein.

As the length of fluorescent lamps used for backlighting liquid crystal displays and other applications increases with the size of the display, an imbalance in brightness between the ends of the fluorescent lamps becomes noticeable. If the fluorescent lamps are driven by a single-ended voltage source, the grounded ends of the fluorescent lamps are not as bright as the driven ends for reasons explained below. This difference in brightness detracts from the quality of the display. Various circuits have been designed to correct this problem, such as driving the fluorescent lamps with an inverter voltage at each end of the fluorescent lamps.

Figure 1:
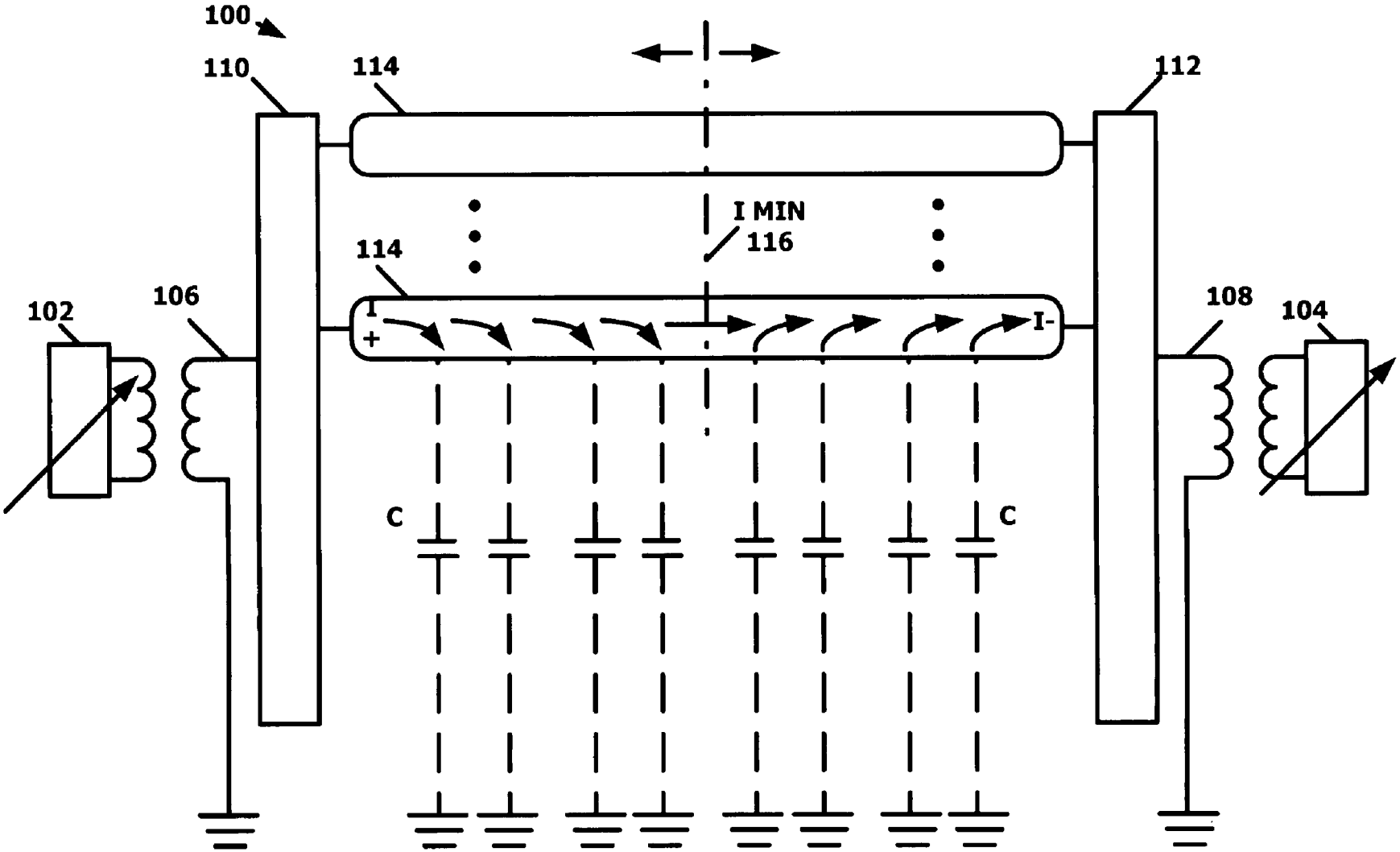
FIG. 1 illustrates a simplified schematic diagram of a fluorescent lamp compensator circuit according to the prior art.

FIG. 1 illustrates a simplified schematic diagram of a fluorescent lamp compensator circuit 100 according to the prior art. Shown in FIG. 1 are inverters 102 and 104, inverter transformers 106 and 108, a current balancing circuit 110, a power distribution circuit 112, fluorescent lamps 114, a minimum current column 116, current flows I+ and I–, and a distributed parasitic capacitance C.

In FIG. 1, the two inverters 102 and 104 drive the transformers 106 and 108 respectively to illuminate the fluorescent lamps 114. In this example, the current balancing circuit 110 regulates the current through each of the fluorescent lamps 114. The power distribution circuit 112 may be simply an array of connectors that connect the output of the transformer 108 to the fluorescent lamps 114. Driving the fluorescent lamps 114 from each end with inverter voltages having opposite polarity partially mitigates the problem of unequal brightness. However, there is still a problem as illustrated by the leakage current flows I+ and I− through the distributed parasitic capacitance C. The distributed parasitic capacitance C is needed to strike, that is, ionize, the fluorescent lamps 114. However, once the current flows I+ and I− are established, the leakage current through the distributed parasitic capacitance C results in a maximum total current and a corresponding maximum light output at the ends of the fluorescent lamps 114 and a region of minimum current flow and a corresponding minimum light output at the minimum current column 116. If all the components in the lamp compensator circuit 100 were perfectly matched, the minimum current column 116 would be exactly in the middle of the fluorescent lamps 114 where it is least noticeable, and the ends of the fluorescent lamps 114 would appear equally bright.

Due to manufacturing variations and changes in component values with temperature, however, the minimum current column 116 is not exactly in the middle of the fluorescent lamps 114, and the ends of the fluorescent lamps 114 do not appear equally bright. The location of the minimum current column 116 may be moved away from either end of the fluorescent lamps 114 by increasing the inverter voltage output at the same end or by decreasing the inverter voltage output at the opposite end. Accordingly, the minimum current column 116 may be centered, for example, by manually adjusting one or both of the inverter voltages until the ends of the fluorescent lamps 114 appear equally bright.

A disadvantage of manually adjusting the inverter voltages is that the possibility of human error and the added labor expense is added to the cost burden of the product. Also, additional adjustments may be needed in the field due to correct the difference in light output at opposite ends of the fluorescent lamps 114 due changes in inverter voltage, lamp current, and lamp temperature over time. A preferable method of correcting the difference in light output at opposite ends of the fluorescent lamps 114 would be to adjust the inverter voltages automatically to compensate for component mismatch and changes in inverter voltage, fluorescent lamp current, and circuit temperature.

In one embodiment, an electrical circuit for correcting a difference in light output at opposite ends of a fluorescent lamp array includes:

a microcontroller and firmware for generating a first pulse-width modulated inverter switch control signal having a first duty cycle that may be varied by computer program instructions executed by the microcontroller; and an inverter bridge driver coupled to the microcontroller for generating a switching signal for a first inverter bridge from the first pulse-width modulated inverter switch control signal to generate a first inverter voltage having a magnitude determined by the first duty cycle.

Figure 2:
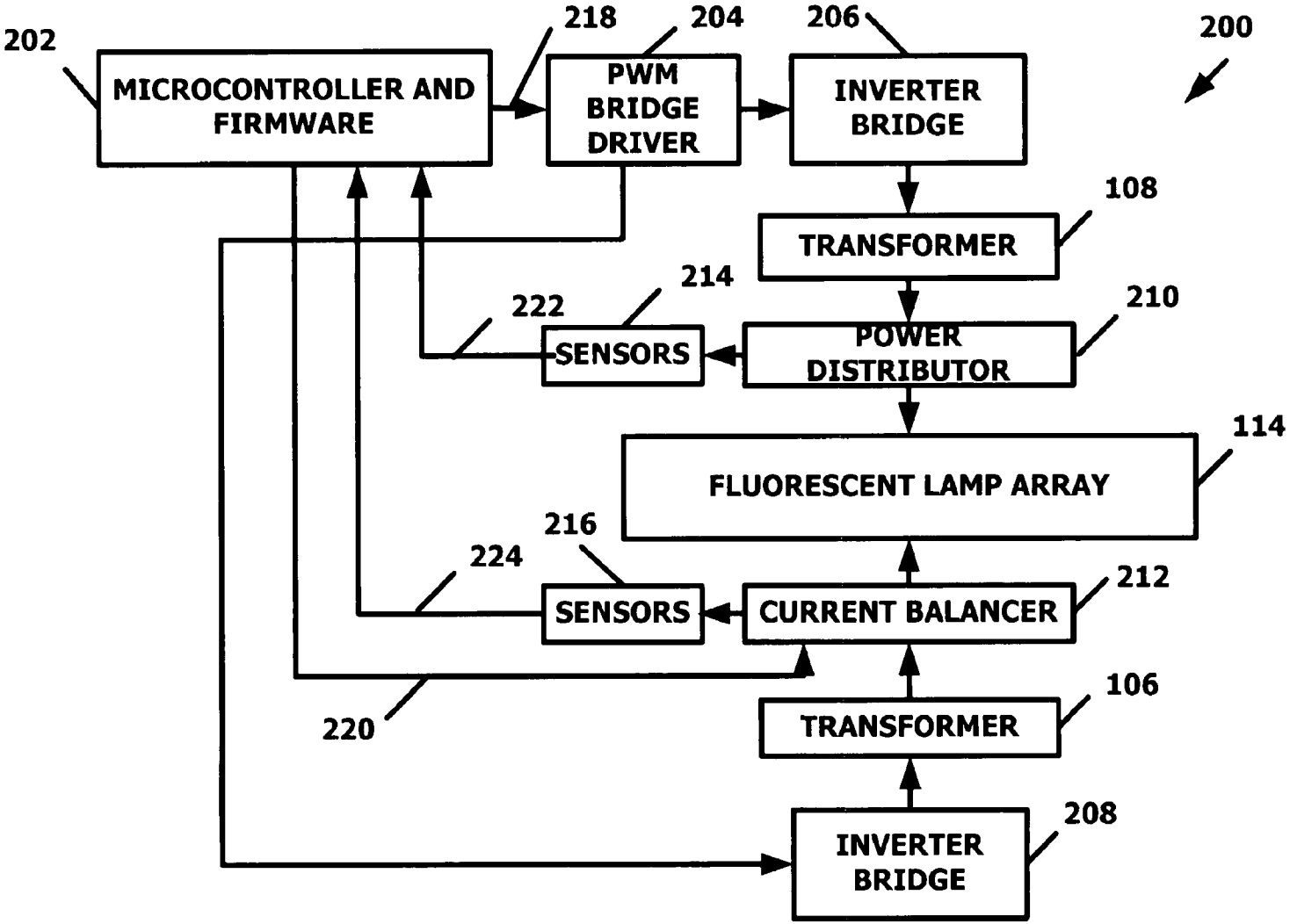
FIG. 2 illustrates a block diagram of an electrical circuit for correcting a difference in light output at opposite ends of a fluorescent lamp array.

FIG. 2 illustrates a block diagram of an electrical circuit 200 for correcting a difference in light output at the ends of a fluorescent lamp array. Shown in FIG. 2 are inverter transformers 106 and 108, an array of fluorescent lamps 114, a microcontroller and firmware circuit 202, a pulse-width modulation inverter bridge driver 204, inverter bridges 206 and 208, a power distribution circuit 210, a current balancing circuit 212, sensors 214 and 216, pulse-width modulated inverter switch control signals 218, current control signals 220, and feedback signals 222 and 224.

In FIG. 2, the inverter transformers 106 and 108, the power distribution circuit 112, and the array of fluorescent lamps 114 may be, for example, the same as those in FIG. 1. The fluorescent lamps 114 may include any type of light-emitting device driven by an inverter, including cold-cathode fluorescent lamps (CCFL) and external electrode fluorescent lamps (EEFL). The inverter bridges 206 and 208 may be, for example, H-bridge circuits comprising common switching components. The microcontroller and firmware circuit 202 may be, for example, an integrated circuit microcomputer that can execute instructions from firmware located on-chip or on a peripheral device connected to the microcomputer. The pulse-width modulation inverter bridge driver 204 is connected directly to a digital output port of the microcontroller and firmware circuit 202 and preferably does not include analog timing components. The power distribution circuit 210 connects the inverter transformer 108 to the array of fluorescent lamps 114 and may also include the sensors 214. The current balancing circuit 212 connects the inverter transformer 106 to the array of fluorescent lamps 114 and may also include the sensors 216. Also, the current balancing circuit 212 regulates the current from the transformer 106 through each of the fluorescent lamps 114 in response to a corresponding one of the current control signals 220 received from the microcontroller and firmware circuit 202. In one embodiment, the current balancing circuit 212 includes a switching element connected in series with each of the fluorescent lamps 114. The current control signals 220 are converted to pulse-width modulated signals that control the switching elements to regulate the current through each of the fluorescent lamps 114 independently. In another embodiment, the power distribution circuit 210 is replaced by another current balancing circuit 212.

The sensors 214 and 216 measure parameters from the array of fluorescent lamps 114 and generate the feedback signals 222 and 224. Examples of the feedback signals 222 and 224 include the inverter voltage output, the average current through each of the fluorescent lamps in the array of fluorescent lamps 114, the temperature of one or more of the array of fluorescent lamps 114, and the light output of at least each end of the array of fluorescent lamps 114. The light output at each end of the array of fluorescent lamps 114 may be measured, for example, by placing photodetectors at the ends of the fluorescent lamps 114 and connecting the outputs of the photodetectors at the same end of the array of fluorescent lamps 114 in series. Alternatively, the photodetector outputs may be measured separately and used both for comparing the light output at the ends of the fluorescent lamps 114 and for correcting differences in light output from one of the fluorescent lamps 114 to another.

In operation, the microcontroller and firmware circuit 202 generates a pulse-width modulated (PWM) signal 218 for each of the inverter bridges 206 and 208. The pulse-width modulation inverter bridge driver 204 generates switching signals for each switch in the inverter bridge 206 or 208 from the corresponding pulse-width modulated (PWM) signal 218. The PWM signals 218 each have a duty cycle and a frequency that may be varied independently by computer program instructions in the microcontroller and firmware circuit 202 to determine the magnitude and the frequency of each of the inverter voltages output from the transformers 106 and 108.

Figure 3:
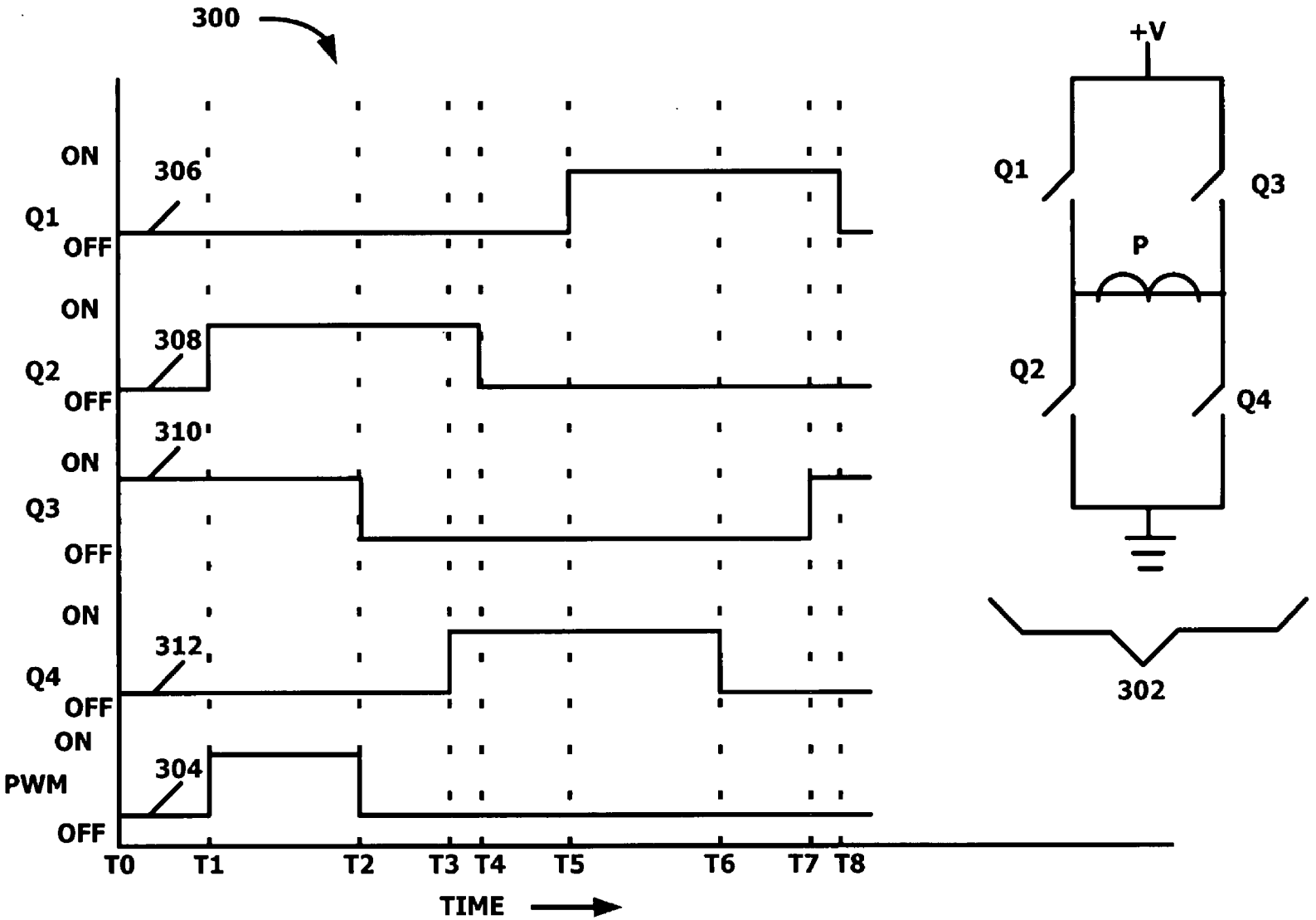
FIG. 3 illustrates a timing diagram of an example of the switching signals generated for one of the inverter bridges by the inverter bridge driver in FIG. 2.

FIG. 3 illustrates a timing diagram 300 of an example of the switching signals generated for one of the inverter bridges by the inverter bridge driver 204 in FIG. 2. Shown in FIG. 3 are an H-bridge 302, a PWM inverter switch control signal 304, a Q1 switching signal 306, a Q2 switching signal 308, a Q3 switching signal 310, and a Q4 switching signal 312.

In FIG. 3, the H-bridge 302, also known as a full bridge, includes the four switches Q1, Q2, Q3, and Q4 that switch the inverter transformer primary P to the voltage +V and ground. The PWM inverter switch control signal 304 has a duty cycle represented by the time between T1 and T2 and a period represented by the time between T0 and T8. The switching signals 306, 308, 310, and 312 ensure that the voltage +V is never shorted to ground through Q1 and Q2 or through Q3 and Q4, which could result in damage to components and excessive power consumption. When the switches Q1 and Q4 are on, current flows through the primary P from left to right. When the switches Q2 and Q3 are on, current flows through the primary P from right to left. Reversing the polarity, that is, alternating, the current flow through the primary P generates the inverter voltage output from the secondary of the inverter transformer. The magnitude and frequency of the inverter voltage are determined by the duty cycle and the frequency of the PWM inverter switch control signal 304. The inverter voltage outputs from the transformers 106 and 108 are connected to the array of fluorescent lamps 114 out of phase, so that when one inverter voltage has positive polarity, the other inverter voltage has negative polarity.

The microcontroller and firmware circuit 202 in FIG. 2 adjusts the duty cycle of one or both of the PWM inverter switch control signals 218 to correct a difference in light output at opposite ends of the array of fluorescent lamps 114. The microcontroller and firmware circuit 202 can also change the current control signals 220 to correct a difference in light output between one fluorescent lamp and another in the fluorescent lamp array 114 so that all the fluorescent lamps 114 have the same light output. The duty cycle of the PWM inverter switch control signals 218 and the values of the current control signals 220 may be calculated by the microcontroller and firmware circuit 202 from a mathematical function, for example, from a closed loop servo, from a polynomial function with feedback, or from a calibration database without feedback.

Figure 4:
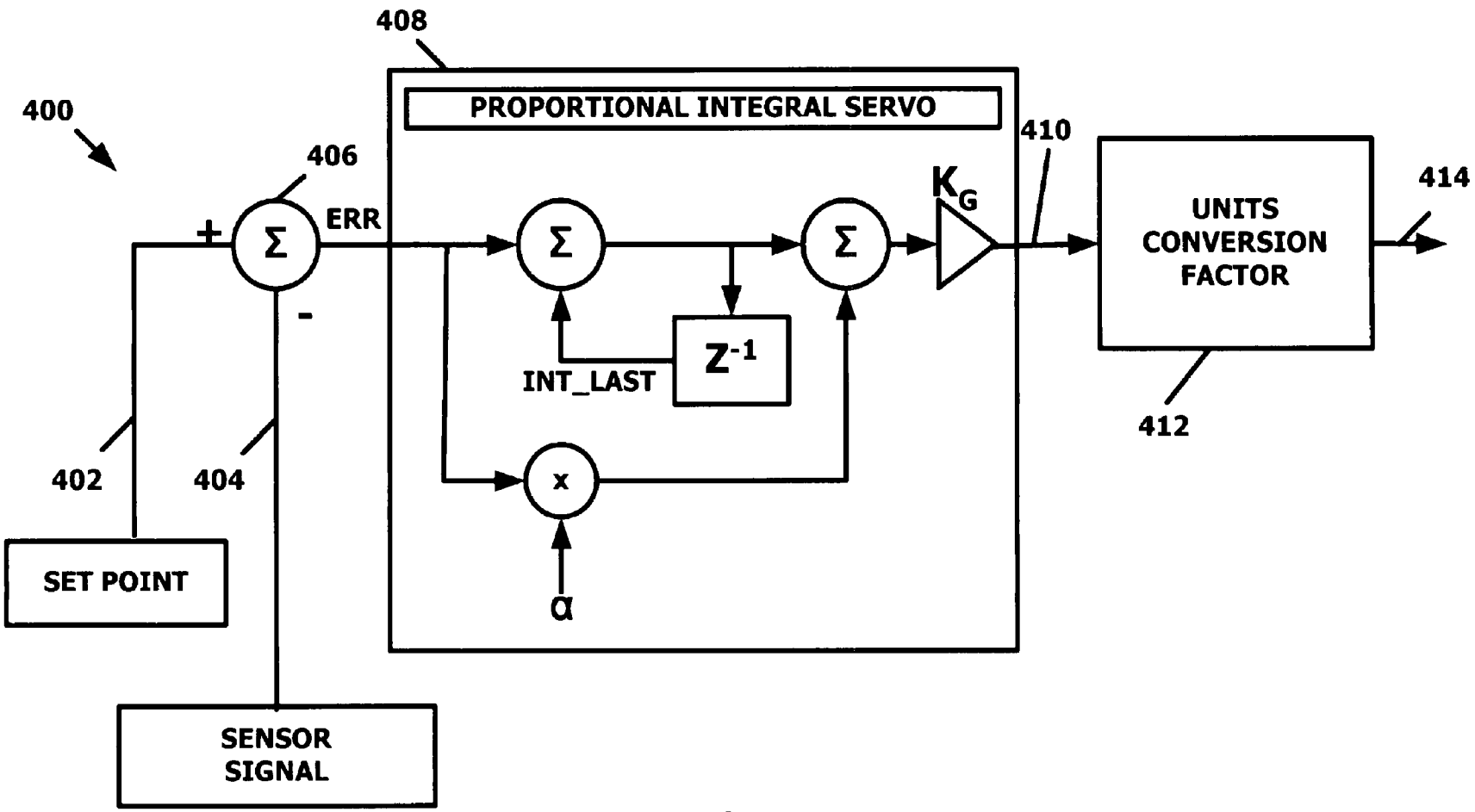
FIG. 4 illustrates a closed loop servo for correcting a difference in light output between opposite ends of the array of fluorescent lamps in FIG. 2.

FIG. 4 illustrates a closed loop servo 400 for correcting a difference in light output between opposite ends of the array of fluorescent lamps 114 in FIG. 2. Shown in FIG. 4 are a set point 402, a sensor signal 404, a summing function 406, a proportional integral servo 408, an adjustment value 410, a units conversion factor 412, and a duty cycle correction value 414.

In FIG. 4, the set point 402 is a selected parameter that corresponds to the desired light output of one end of the array of the fluorescent lamps 114 in FIG. 2. The selected parameter may be, for example, photodetector current, lamp current, or inverter voltage. In one embodiment, the set point value 402 is found during calibration and stored in a calibration database. The calibration database includes a record of parameters measured during calibration. The measured parameter values may be accessed by the microcontroller and firmware 202 according to well-known computer design techniques. The sensor signal 404 may be, for example, one of the feedback signals 220 or 222.

The sensor signal 404 is subtracted from the set point 402 by the summing function 406 to generate the error signal err according to $$err = \text{Set_Point} - \text{Sensor_Signal} \quad (1)$$

The resulting error signal err from the summing function 406 is subjected to the proportional integral servo 408 to generate the adjustment value 410 for the selected parameter according to $$\text{Adjustment_value} = (\alpha * err + int_\text{last}) * KG \quad (2)$$

where

Adjustment_value is the integrated error output;

$\alpha$ is a feedback constant;

int_last is the cumulative sum of the current and previous values of err; and $K_G$ is a loop gain constant.

In one embodiment, the loop gain $K_G = 1.975 \times 10^{-3}$ and $\alpha = 39.5$ to provide a damping ratio of 0.9 to allow for open loop variation tolerances. In this example, the servo loop is performed at periodic intervals of two seconds.

The error signal err is summed with the previous errors:

$$int_\text{last} = int_\text{last} + err \quad (3)$$

The proportional integral servo 408 is preferably embodied in the firmware according to well-known programming techniques and calculated by the microprocessor and firmware 202 to generate the adjustment value 410. The adjustment value 410 is multiplied by the units conversion factor 412 to convert the selected parameter units to the duty cycle correction value 414 for one of the duty cycle modulated inverter control signals 218. For example, an adjustment value 410 in lamp current of +10 microamperes may be converted to a duty cycle correction of +4 microseconds.

The feedback signals 222 and 224 from the sensors 214 and 216 may also be used to calculate the duty cycle of the PWM inverter switch control signals 218 by retrieving polynomial coefficients from a calibration database and calculating a value for the duty cycle of each of the PWM inverter switch control signals 218 as a function of the measured value of the feedback signals 222 and 224. For example, a polynomial function of lamp temperature for calculating the duty cycle of the PWM inverter switch control signal 218 for the left side of the array of fluorescent lamps 114 is given by the following equation:

$$DCL(T) = DCL0 + DCL1 * T + DCL2 * T^2 + DCL3 * T^3 + \quad (4)$$

where DCL is the duty cycle of the PWM inverter switch control signal 218 for the left side of the array of fluorescent lamps 114, T is the average temperature of the fluorescent lamps 114, and DCL0, DCL1, DCL2, DCL3, . . . are polynomial coefficients determined according to well-known techniques by calibrating the duty cycle of the PWM inverter switch control signal 218 for the left side of the array of fluorescent lamps 114 at different temperatures when the array of fluorescent lamps 114 is manufactured.

Likewise, a polynomial function for calculating the duty cycle of the PWM inverter switch control signal 218 for the right side of the array of fluorescent lamps 114 is given by the following equation:

$$DCR(T) = DCR0 + DCR1 * T + DCR2 * T^2 + DCR3 * T^3 + \quad (5)$$

where DCR is the duty cycle of the PWM inverter switch control signal 218 for the right side of the array of fluorescent lamps 114, T is the average temperature of the fluorescent lamps 114, and DCR0, DCR1, DCR2, DCR3, . . . are polynomial coefficients determined according to well-known techniques by calibrating the duty cycle of the PWM inverter switch control signal 218 for the right side of the array of fluorescent lamps 114 at different temperatures.

In addition to temperature, polynomial functions may be used to calculate the duty cycle of the PWM inverter switch control signals 218 as a function of inverter voltage, lamp current, or light output in the same manner as for temperature. Likewise, values of the current control signals 220 may be calculated by retrieving polynomial coefficients from the calibration database and calculating a value for each of the current control signals 220 as a function of temperature, lamp current, or light output in the same manner.

In a further embodiment, the duty cycles of the PWM inverter switch control signals 218 and values for the current control signals 220 may be retrieved as pre-determined constants by the microcontroller and firmware 202 from the calibration database without feedback.

The servo control loop function illustrated in FIG. 4 may also be used to regulate the current of each of the fluorescent lamps 114 by generating a correction to each of the current control signals 220 in response to the lamp current of each of the fluorescent lamps 114 measured by the sensors 214 and 216.

In another embodiment, firmware for correcting a difference in light output at opposite ends of a fluorescent lamp array includes steps of;

generating a first pulse-width modulated inverter switch control signal having a first duty cycle that may be varied by computer program instructions executed by a microcontroller; and generating a switching signal for a first inverter bridge from the first pulse-width modulated inverter switch control signal to generate a first inverter voltage having a magnitude determined by the first duty cycle.

Figure 5:
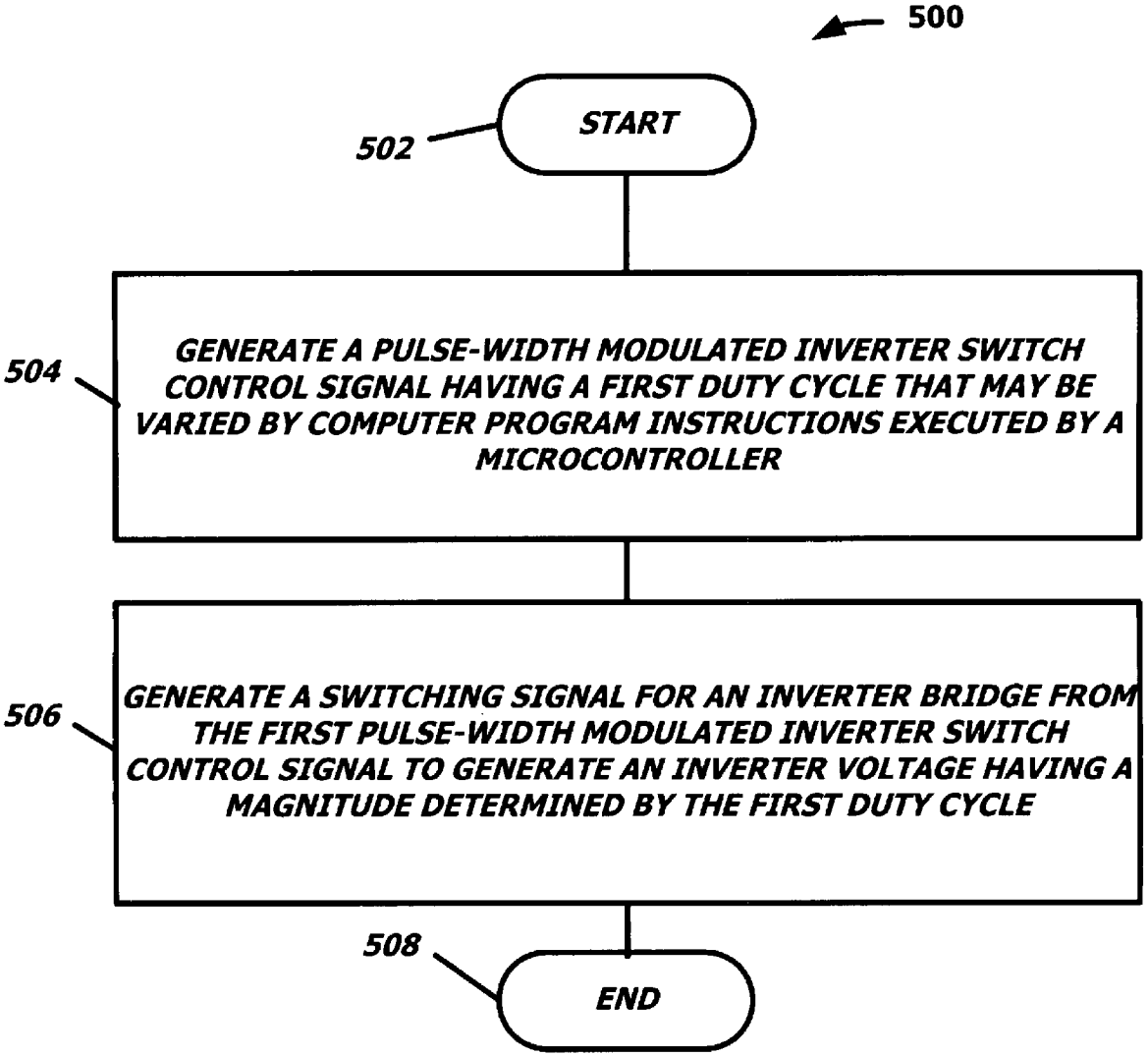
FIG. 5 illustrates a flow chart for a method of correcting a difference in light output at opposite ends of a fluorescent lamp array.

FIG. 5 illustrates a flow chart 500 for a method of correcting a difference in light output at opposite ends of a fluorescent lamp array.

Step 502 is the entry point of the flow chart 500

In step 504, a pulse-width modulated (PWM) inverter switch control signal 218 is generated for each of the inverter bridges 206 and 208 from computer program instructions executed by the microcontroller 202 in FIG. 2. The pulse-width modulated inverter control signals 218 may each be generated, for example, by gating the pulse-width modulated inverter control signal 218 according to the number of clock pulses counted by two modulus counters. The pulse-width modulated inverter control signal 218 is gated ON until the first modulus counter signals a full count corresponding to the duty cycle of the pulse-width modulated inverter control signal 218. The pulse-width modulated inverter control signal 218 is then gated OFF until the second modulus counter signals a full count corresponding to the period of the pulse-width modulated inverter control signal 218. The modulus counters are then reset, and the cycle is repeated. The duty cycle is equal to the first modulus divided by the second modulus.

In step 506, switching signals are generated for each of the inverter bridges 206 and 208 from the pulse-width modulated inverter control signals 218 by the PWM bridge driver 204. The inverter transformers 106 and 108 generate an inverter voltage from each of the inverter bridges 206 and 208. Each inverter voltage has a magnitude that is determined by the duty cycle of the corresponding pulse-width modulated inverter switch control signal 218. The duty cycle of one or both of the pulse-width modulated inverter switch control signals 218 may be varied independently by the microcontroller and firmware 202 to correct a difference in light output at opposite ends of the array of fluorescent lamps 214.

Step 508 is the exit point of the flow chart 500.

Figure 6A:
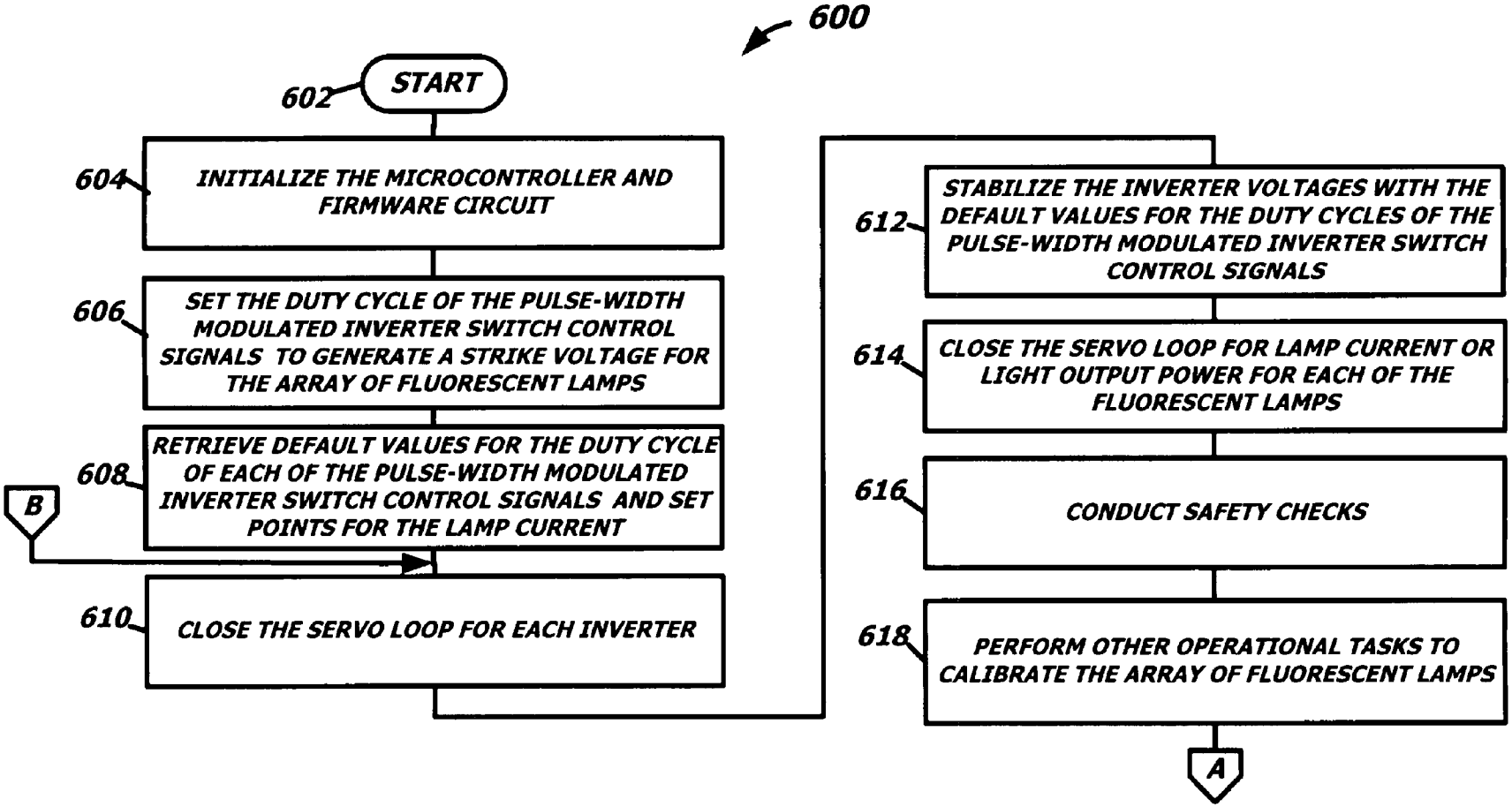
FIG. 6 illustrates a flow chart for a method of calibrating an array of fluorescent lamps.
Figures 6, 6B:
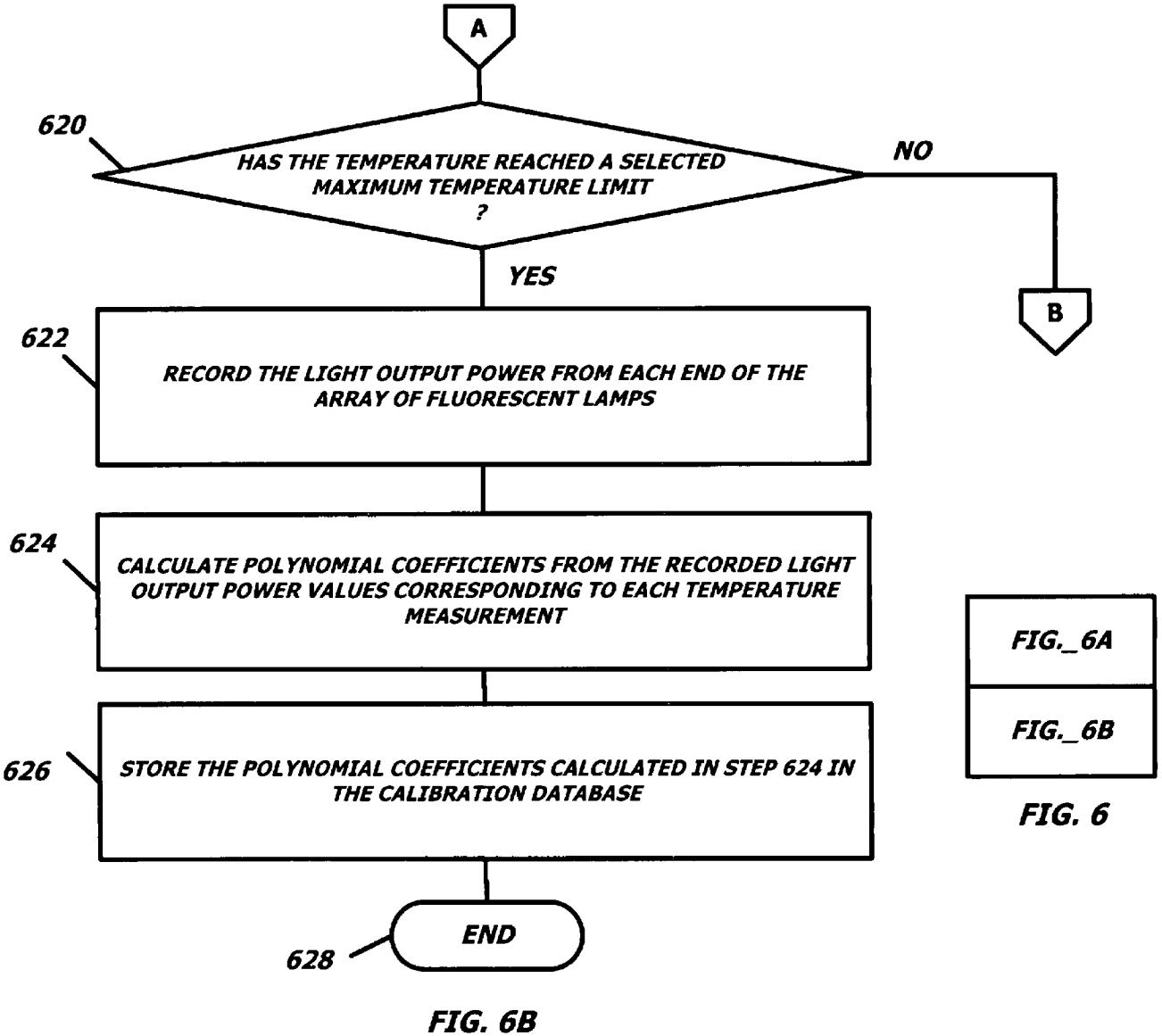

FIG. 6 illustrates a flow chart 600 for a method of calibrating an array of fluorescent lamps.

Step 602 is the entry point of the flow chart 600.

In step 604, the microcontroller and firmware circuit 202 is initialized according to well-known microcomputer techniques.

In step 606, the microcontroller and firmware circuit 202 sets the duty cycle of the pulse-width modulated inverter switch control signals 218 to generate a strike voltage for the array of fluorescent lamps 114.

In step 608, the microcontroller and firmware circuit 202 retrieves default values for the duty cycle of each of the pulse-width modulated inverter switch control signals 218 and set points for the lamp current corresponding to a uniform light output power at each end of the array of fluorescent lamps 114 from the calibration database for the type and model of the fluorescent lamps 114.

In step 610, the microcontroller and firmware circuit 202 closes the servo loop for each inverter with the feedback signals 222 and 224 from the sensors 214 and 216.

In step 612, the microcontroller and firmware circuit 202 stabilizes the inverter voltages with the default values for the duty cycles of the pulse-width modulated inverter switch control signals 218.

In step 614, the microcontroller and firmware circuit 202 closes the servo loop for lamp current or light output power for each of the fluorescent lamps 114 with the feedback signals 222 and 224 from the sensors 214 and 216 as described above.

In step 616, the microcontroller and firmware circuit 202 conducts safety checks such as overvoltage and excessive lamp current. In one embodiment, if a safety threat is detected, the inverters are switched off until a reset switch is activated or until the power to the microcontroller and firmware circuit 202 is switched off and restored.

In step 618, the microcontroller and firmware circuit 202 performs other operational tasks to calibrate the array of fluorescent lamps 114, such as stepping through different values of lamp current and inverter voltage.

In step 620, the microcontroller and firmware circuit 202 checks the temperature of the array of fluorescent lamps 114. If the temperature has reached a selected maximum temperature limit, the flow chart 600 continues from step 624. Otherwise, the flow chart 600 continues from step 622.

In step 622, the microcontroller and firmware circuit 202 records the light output power from each end of the array of fluorescent lamps 114. The light output power from each end of the array of fluorescent lamps 114 may be measured externally and communicated to the microcontroller and firmware circuit 202 via a user interface, or the light output power from each end of the array of fluorescent lamps 114 may be measured internally by the sensors 214 and 216 as described above. The flow chart then continues from step 610.

In step 624, the microcontroller and firmware circuit 202 calculates polynomial coefficients from the recorded light output power values corresponding to each temperature measurement according to well-known mathematical techniques.

In step 626, the microcontroller and firmware circuit 202 stores the polynomial coefficients calculated in step 624 in the calibration database. The polynomial coefficients may be used later to maintain uniform light output power at opposite ends of the fluorescent lamp array.

Step 628 is the exit point of the flow chart 600.

Figure 7:
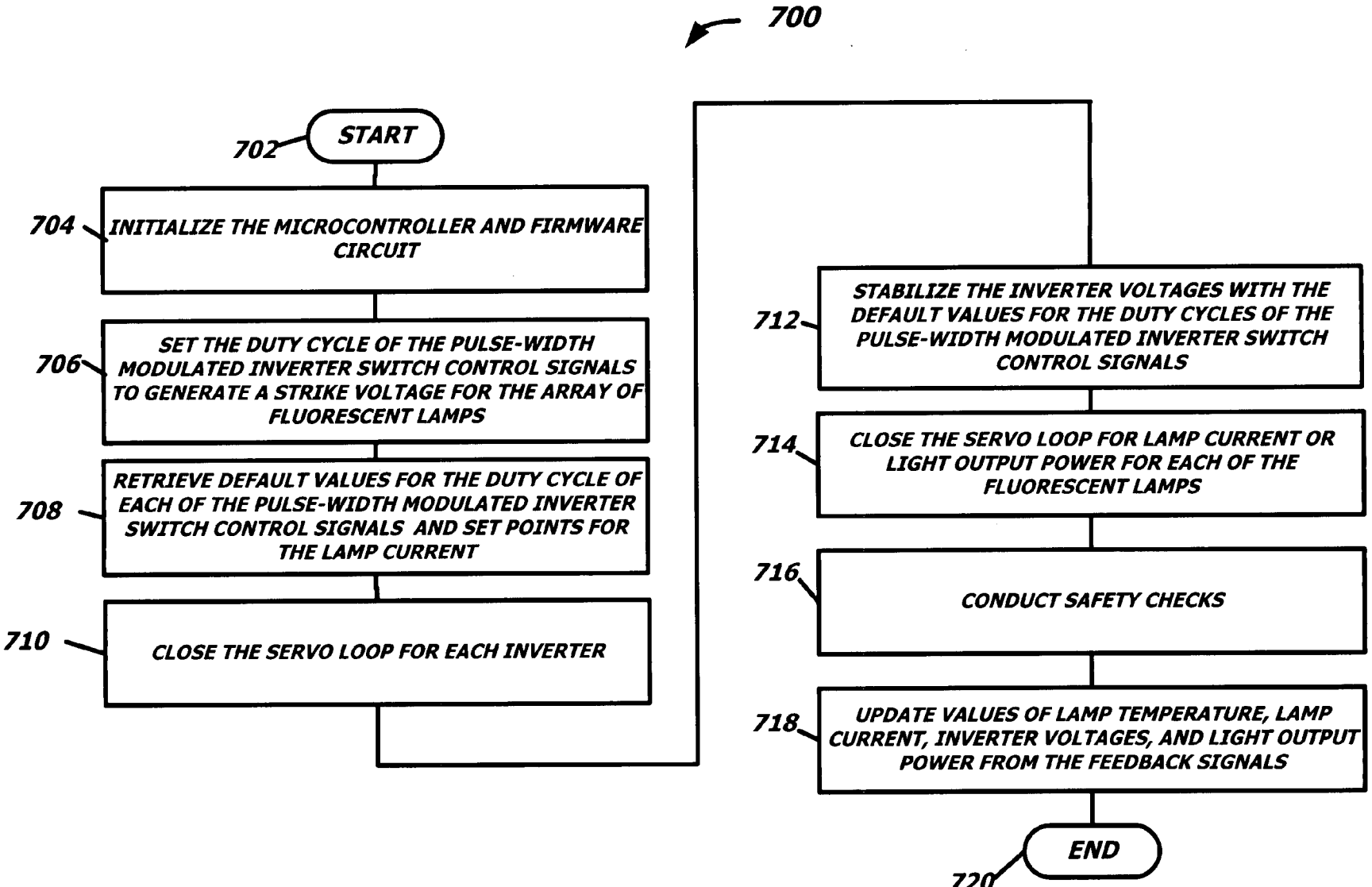
FIG. 7 illustrates a flow chart for a method of maintaining left-to-right uniformity of light power output at opposite ends of an array of fluorescent lamps.

FIG. 7 illustrates a flow chart 700 for a method of maintaining left-to-right uniformity of light power output at opposite ends of an array of fluorescent lamps.

Step 702 is the entry point of the flow chart 700.

In step 704, the microcontroller and firmware circuit 202 is initialized according to well-known microcomputer techniques.

In step 706, the microcontroller and firmware circuit 202 sets the duty cycle of the pulse-width modulated inverter switch control signals 218 to generate a strike voltage for the array of fluorescent lamps 114.

In step 708, the microcontroller and firmware circuit 202 retrieves default values for the lamp current set points and the polynomial coefficients from the calibration database.

In step 710, the microcontroller and firmware circuit 202 closes the servo loop for each inverter with the feedback signals 222 and 224 from the sensors 214 and 216.

In step 712, the microcontroller and firmware circuit 202 stabilizes the inverter voltages with the default values for the duty cycles of the pulse-width modulated inverter switch control signals 218.

In step 714, the microcontroller and firmware circuit 202 closes the servo loop for lamp current or light output power for each of the fluorescent lamps 114 with the feedback signals 222 and 224 from the sensors 214 and 216 as described above.

In step 716, the microcontroller and firmware circuit 202 conducts safety checks such as overvoltage and excessive lamp current. In one embodiment, if a safety threat is detected, the inverters are switched off until a reset switch is activated or until the power to the microcontroller and firmware circuit 202 is switched off and restored.

In step 718, the microcontroller and firmware circuit 202 updates values of lamp temperature, lamp current, inverter voltages, and light output power from the feedback signals 222 and 224 from the sensors 214 and 216, and the flow chart continues from step 712.

Step 720 is the exit point of the flow chart 700.

By automating the adjustments to the PWM inverter switch control signals and the current control signals with a digital servo control loop or a polynomial function as described above, the light output at opposite ends of the fluorescent lamps for a wide variety of fluorescent lamp arrays may be matched continuously as component behavior changes with temperature and aging, advantageously maintaining a light output that is equally bright at the ends of the array of fluorescent lamps and that is the same for each one of the fluorescent lamps.

Although the flowchart description above is described and shown with reference to specific steps performed in a specific order, these steps may be combined, sub-divided, or reordered without departing from the scope of the claims. Unless specifically indicated, the order and grouping of steps is not a limitation of other embodiments that may lie within the scope of the claims.

The specific embodiments and applications thereof described above are for illustrative purposes only and do not preclude modifications and variations that may be made within the scope of the following claims.

What is claimed is:

1. An electrical circuit, comprising:

a controller configured to:

generate a first pulse-width modulated inverter switch control signal with a first duty cycle and generate a current control signal, wherein the current control signal is configured to control current flow through a fluorescent lamp in a fluorescent lamp array; and generate a second pulse-width modulated inverter switch control signal with a second duty cycle that is different than the first duty cycle; and an inverter bridge driver coupled to the controller, wherein the inverter bridge driver is configured to:

generate a first switching signal for a first inverter bridge based on the first pulse-width modulated inverter switch control signal and thereby generate a first inverter voltage with a magnitude based on the first duty cycle; and generate a second switching signal for a second inverter bridge based on the second pulse-width modulated inverter switch control signal and thereby generate a second inverter voltage with a magnitude based on the second duty cycle.

2. The electrical circuit of claim 1, further comprising a power distribution circuit coupled to the inverter bridge driver, wherein the power distribution circuit is configured to provide the first inverter voltage to the fluorescent lamp array.

3. The electrical circuit of claim 2, further comprising a sensor coupled to the controller, wherein the sensor is configured to measure light output, inverter voltage, lamp current, or lamp temperature to thereby generate a feedback signal with respect to the fluorescent lamp in the fluorescent lamp array.

4. The electrical circuit of claim 3, wherein the controller is further configured to determine the first duty cycle based on the feedback signal.

5. The electrical circuit of claim 4, wherein the controller is further configured to determine the feedback signal based on a closed-loop servo.

6. The electrical circuit of claim 3, wherein the controller is further configured to determine the second duty cycle based on the feedback signal.

7. The electrical circuit of claim 6, wherein the controller is further configured to determine the feedback signal based on a closed-loop servo.

8. The electrical circuit of claim 3, wherein the controller is further configured to determine a value of the current control signal based on the feedback signal.

9. The electrical circuit of claim 8, wherein the controller is further configured to determine the feedback signal based on a closed-loop servo.

10. The electrical circuit of claim 1, further comprising a current-balancing circuit coupled to the controller, wherein the current-balancing circuit is configured to regulate lamp current through the fluorescent lamp in the fluorescent lamp array based on the current control signal.

11. The electrical circuit of claim 1, wherein the controller is further configured to determine the first duty cycle or the second duty cycle to thereby reduce a difference in light output at opposite ends of the fluorescent lamp array.

12. The electrical circuit of claim 11, wherein the controller is further configured to determine the first duty cycle or the second duty cycle as a polynomial function from a polynomial coefficient retrieved from a calibration database.

13. The electrical circuit of claim 12, further comprising a memory configured to store the calibration database, wherein the calibration database includes polynomial coefficients configured to be used to determine the first duty cycle or the second duty cycle as a function of inverter voltage, fluorescent lamp current, fluorescent lamp temperature, or fluorescent lamp light output.

14. The electrical circuit of claim 1, wherein the controller is further configured to determine a value of the current control signal that reduces a difference in light output from one fluorescent lamp to another fluorescent lamp in the fluorescent lamp array.

15. The electrical circuit of claim 14, wherein the controller is further configured to determine the value of the current control signal as a polynomial function from a polynomial coefficient retrieved from a calibration database.

16. The electrical circuit of claim 15, further comprising a memory configured to store the calibration database, wherein the calibration database includes polynomial coefficients configured to be used to determine the value of the current control signal as a function of fluorescent lamp current, fluorescent lamp temperature, or fluorescent lamp light output.

17. A method, comprising:

generating a first pulse-width modulated inverter switch control signal having a first duty cycle;

generating a current control signal, wherein the current control signal is configured to control current flow through one or more fluorescent lamps in a fluorescent lamp array;

generating a second pulse-width modulated inverter switch control signal having a second duty cycle that is different than the first duty cycle;

generating a first switching signal for a first inverter bridge from the first pulse-width modulated inverter switch control signal to thereby generate a first inverter voltage having a magnitude based on the first duty cycle; and generating a second switching signal for a second inverter bridge from the second pulse-width modulated inverter switch control signal to thereby generate a second inverter voltage having a magnitude based on the second duty cycle.

18. The method of claim 17, further comprising measuring a fluorescent lamp light output, inverter voltage, fluorescent lamp current, or fluorescent lamp temperature to generate a feedback signal with respect to a fluorescent lamp in the fluorescent lamp array.

19. The method of claim 18, further comprising determining the first duty cycle based on the feedback signal.

20. The method of claim 19, further comprising determining the feedback signal from a closed-loop servo.

21. The method of claim 18, further comprising determining the second duty cycle based on the feedback signal.

22. The method of claim 21, further comprising determining the feedback signal from a closed-loop servo.

23. The method of claim 18, further comprising determining a value of the current control signal based on the feedback signal.

24. The method of claim 23, further comprising determining the feedback signal from a closed-loop servo.

25. The method of claim 17, further comprising determining the first duty cycle or the second duty cycle to thereby reduce a difference in light output at opposite ends of the fluorescent lamp array.

26. The method of claim 17, further comprising determining a third duty cycle of the current control signal to thereby reduce a difference in light output from one fluorescent lamp to another fluorescent lamp of the fluorescent lamp array.

27. The method of claim 17, further comprising determining the first duty cycle or the second duty cycle as a polynomial function from a polynomial coefficient retrieved from a calibration database.

28. The method of claim 17, further comprising determining a value of the current control signal as a polynomial function from a polynomial coefficient retrieved from a calibration database.

29. The method of claim 17, further comprising retrieving the first duty cycle and the second duty cycle from a calibration database.

30. The method of claim 17, further comprising retrieving a value of the current control signal from a calibration database.

* * * * *